US005579932A

United States Patent [19]

Drozd et al.

[11] Patent Number: 5,579,932

[45] Date of Patent: Dec. 3, 1996

[54] CLOSURE WITH OUTER DRIVER HAVING MOVABLE SEGMENTS FORMING MANUAL ENGAGEMENT MEMBER

[75] Inventors: Edward J. Drozd, Lake Hiawatha; Vincent Comitini, Cranford, both of N.J.

[73] Assignee: Lincoln Mold and Dye Corporation, Roselle, N.J.

[21] Appl. No.: 488,531

[22] Filed: Jun. 7, 1995

[51] Int. Cl.[6] ..... B65D 55/14

[52] U.S. Cl. ..... 215/207; 215/201; 215/204; 215/217; 215/220; 215/295; 215/305; 215/333; 215/329; 220/212.5; 220/255; 220/257; 220/263; 220/266; 220/281; 220/283; 220/334; 222/153.1

[58] Field of Search ..... 222/153.03, 153.1; 215/201, 204, 207, 214, 216–221, 250, 228, 251, 253, 277, 316, 329, 330, 331, 337, 295, 305; 220/254, 255, 256, 257, 260, 263, 266, 268, 270, 277, 281, 283, 290, 335, 334; 336, 212, 212.5, 762, 763, 761, 210

[56] References Cited

U.S. PATENT DOCUMENTS

| | | | |
|---|---|---|---|
| 2,063,678 | 12/1936 | Hulme | 222/153.03 X |
| 3,217,949 | 11/1965 | Davis | 220/254 X |
| 3,426,932 | 2/1969 | Rouse | 215/207 |
| 3,690,499 | 9/1972 | Westfall et al. | 215/253 |
| 3,946,889 | 3/1976 | Gach . | |
| 4,371,088 | 2/1983 | Gach . | |
| 4,669,620 | 6/1987 | Coifman . | |
| 4,723,693 | 2/1988 | DeCoster | 220/335 X |
| 4,801,028 | 1/1989 | Puresevic et al. | 215/220 |
| 4,955,513 | 9/1990 | Bennett | 220/339 X |
| 5,005,718 | 4/1991 | Buono . | |
| 5,170,900 | 12/1992 | Manera . | |
| 5,251,774 | 10/1993 | Engle | 220/212.5 X |

*Primary Examiner*—Allan N. Shoap
*Assistant Examiner*—Robin A. Hylton
*Attorney, Agent, or Firm*—Caesar, Rivise, Bernstein, Cohen & Pokotilow, Ltd.

[57] ABSTRACT

A tamper-indicating, child resistant closure for a threaded bottle includes an inner cap and an outer driver telescoped over the inner cap. The inner cap includes a top wall having spaced apart upstanding ribs. The outer driver includes a top wall having a pair of top wall segments hinged for pivotal movement to, and being spaced apart from each other by a spacing rib also forming part of the top wall of the driver. Each of the top wall segments initially is secured to contiguous sections of the outer driver by frangible, tamper-indicating tabs, and the top wall segments are moved from a generally horizontal position to a generally vertical position after the tamper-indicating tabs have been broken to form a driving section in the top wall of the driver. This driving section then is directed into the space between the upstanding ribs associated with the top wall of the inner cap by moving the inner cap and outer driver axially toward each other. In this orientation, the upstanding top wall segments also can be gripped to provide leverage in rotating the driver and inner cap in a counter-clockwise direction to unscrew the closure from the threaded neck of a bottle.

9 Claims, 6 Drawing Sheets

FIG. 5
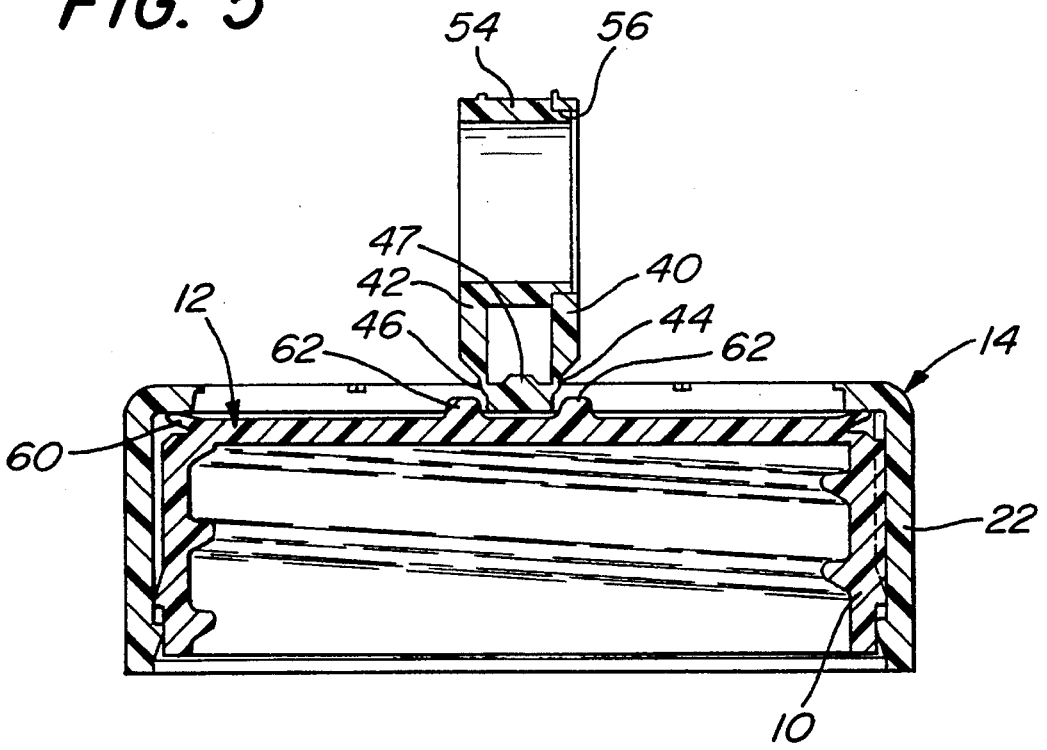
FIG. 6
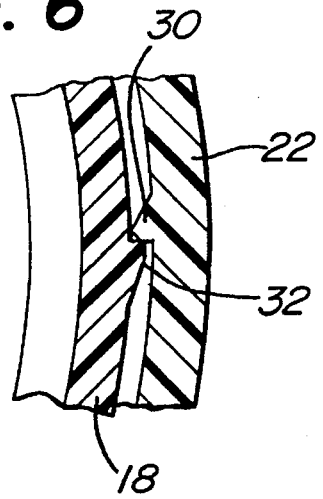
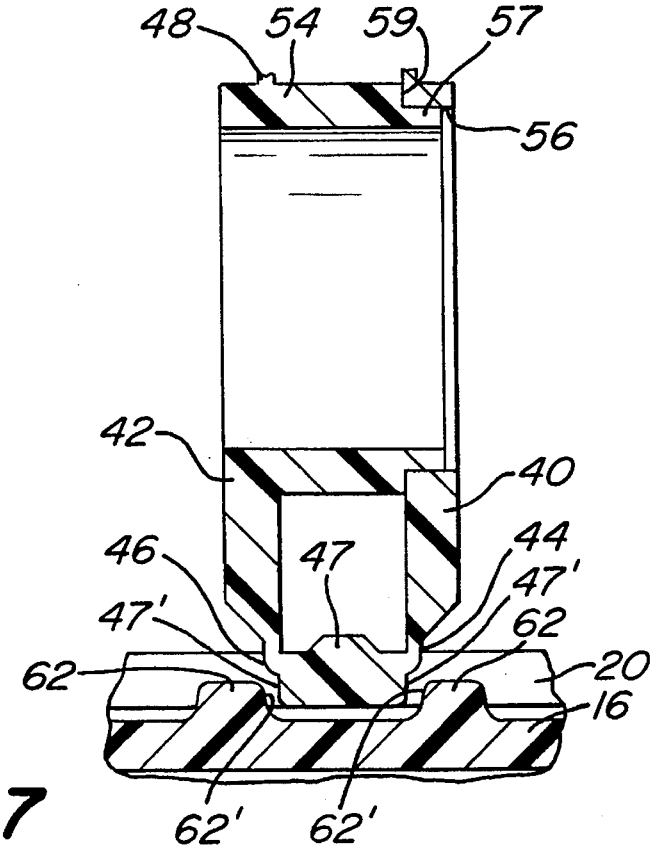
FIG. 7

CLOSURE WITH OUTER DRIVER HAVING MOVABLE SEGMENTS FORMING MANUAL ENGAGEMENT MEMBER

FIELD OF THE INVENTION

This invention relates generally to a tamper-indicating, child resistant closure, and more specifically to a tamper-indicating, child resistant closure for threaded bottles, containers, and the like.

Reference throughout this application to "bottle" or "bottles" is intended to include all types of containers, regardless of the shape thereof or the material employed to make them.

BACKGROUND OF THE ART

The desirability of tamper-indicating, child resistant closures for use with threaded bottles is well recognized in the art. In fact, the prior art is replete with disclosures of such closures.

In U.S. Pat. No. 3,946,889, issued to Gach, a tamper-indicating, child resistant closure employing an inner threaded cap and outer driver telescoped over the inner cap is disclosed. A removable spacer 36 is interconnected to the upper end of element 34 by a thin frangible web 38 that extends around the spacer. After the spacer is removed to separate the movable element from the frangible web a person can open the package by pressing inwardly on the element 34 and rotating the outer driver in a counter-clockwise direction until the element 34 snaps into position behind the abutments on the outside of the skirt of the inner cap, as is illustrated in FIG. 6 of the '889 Gach patent.

U.S. Pat. No. 5,170,900, issued to Manera, discloses a tamper-indicating, child resistant closure including a break-away tab member 14, which needs to be removed from a latch member 9 in order to permit the latch member to be moved linearly into driving engagement with a post 11 extending upwardly from the top wall of an inner cap of the closure system.

U.S. Pat. No. 5,005,718, issued to Buono, discloses a tamper-indicating, child resistant closure assembly including an inner threaded cap and an outer driver. A first set of teeth 34 in the inner cap is designed to cooperate with a second set of teeth 50 forming part of the outer driver when the inner cap and outer driver are moved into axial engagement with each other to thereby permit the opening movement applied to the outer driver to be transmitted to the inner cap. This axial movement initially is precluded by the provision of spacers 62 provided on a segment of the outer cap that is removably connected to the outer cap through frangible tab connections. Once the outer section of the cap is removed by breaking the frangible tab connections, the spacers 62 also are removed to thereby permit the inner and outer caps to be moved axially relative to each other to thereby provide a driving connection between the inner and outer caps to permit the assembly to be open.

U.S. Pat. Nos. 4,669,620, issued to Coifman; 4,527,701, issued to Schaubeck and 4,371,088, issued to Gach, disclose arrangements wherein the axial movement of an outer cap member relative to an inner cap member causes a projection associated with the inner cap member to engage and separate a segment of the top wall of the outer cap member attached to adjacent regions of the outer cap member through frangible tabs. In this way, a visual indication is provided that the assembly has been tampered with.

It also is known in the prior art to provide threaded caps having an upstanding gripping end to provide leverage in rotating the cap to remove it from a threaded bottle. Applicants believe that this is a highly desirable feature, and believe that a need exists to incorporate such a feature into a tamper-indicating child resistant closure. It is to such a closure that the present invention relates.

OBJECTS OF THE INVENTION

It is an object of this invention to provide a tamper-indicating, child resistant closure that reliably precludes removal of the closure unless the tamper-indicating feature is broken or otherwise removed.

It is a further object of this invention to provide a tamper-indicating, child resistant closure that provides a reliable means for obtaining leverage in rotating the closure to remove it from a threaded bottle.

It is a more specific object of this invention to provide a tamper-indicating, child resistant closure that precludes removal of the closure unless a tamper-indicating feature is broken to provide a reliable gripping section for enhancing the leverage in removing the closure from the bottle.

SUMMARY OF THE INVENTION

The above and other objects of this invention are achieved in a tamper-indicating, child resistant closure for a threaded bottle, wherein the closure includes an inner cap and an outer driver. The inner cap includes a top wall and an internally threaded peripheral skirt. The outer driver includes a top wall and a peripheral skirt and this outer driver is telescoped over the inner cap with the top wall of the outer driver being spaced axially outward of the top wall of the inner cap. The top walls of the outer driver and inner cap are axially movable relative to each other, and a biasing means is employed for normally biasing the top walls of the driver and cap axially away from each. Cooperating one-way drive means are provided on adjacent parts of the cap and driver, and these drive means are engagable for permitting rotational motion imparted to the driver to be transmitted to the inner cap for screwing the inner cap onto the bottle.

The closure of this invention includes a unique second drive system for permitting rotational motion imparted to the driver to be transmitted to the inner cap for unscrewing the inner cap from the bottle. This unique drive system includes a pair of top wall segments forming part of the top wall of the outer driver. The pair of top wall segments are hinged for pivotal movement to, and are spaced from each other by a spacing rib that also forms part of the top wall of the outer driver. Each of the top wall segments also are secured to contiguous sections of the outer driver by frangible, tamper-indicating tabs. These top wall segments are prevented from pivotal movement relative to the spacing rib until the frangible tabs are broken. After the frangible tabs are broken, pivotal movement of the top wall segments is permitted so that each of the top wall segments can be moved from a generally horizontal position to a generally vertical position. When the top wall segments are in a generally vertical position they constitute a manually engagable gripping means for providing leverage to rotate the outer driver relative to the inner cap. In addition, when the top wall segments are in a generally vertical position or orientation a driving section is formed on the top wall that can engage with and drive cooperating drive means on the top wall of the inner cap. After the frangible tabs are broken, the top wall segments of the outer driver are pivotally moved out of their generally horizontal position, and the top walls of the outer driver and inner cap are moved axial toward each other against the force of the biasing means to provide a driving connection between the driving section of the driver and the driving means of the inner cap.

In a preferred embodiment of the invention the drive means on the top wall of the inner cap includes a raised projection means for engaging at least a portion of a top wall segment of the top wall of the outer driver when the top wall segment is in a generally horizontal plane for maintaining the top walls of the driver and inner cap axially spaced-apart a sufficient distance to prevent the drive means on the top wall of the inner cap from engaging with and being driven by the driving section of the outer driver.

Most preferably the raised projection means on the top wall of the inner cap includes a pair spaced-apart projections that are spaced-apart a sufficient distance for receiving the driving section of the outer driver therebetween when the top wall segments adjacent the driving rib are disposed in the generally vertical position.

In accordance with the preferred embodiments of this invention, spaced-apart sidewalls of the driving section of the driver engage contiguous walls of the drive means of the inner cap for transmitting a rotational driving force from the driver to the inner cap. In one embodiment of the invention the spaced-apart sidewalls of the driving section are elongate surfaces of the spacing rib. In another embodiment of the invention the spaced-apart sidewalls of the driving section are outwardly facing surfaces of the vertically oriented top wall segments of the driver.

In a preferred form of the invention, securing means are provided for interconnecting the pair of top wall segments together when the top wall segments are disposed in the substantially vertical position, to thereby provide a structurally stable gripping means for assisting in providing leverage to rotate the outer driver.

DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 5 is an enlarged sectional view similar to FIG. 4, but showing the inner cap and outer driver in a cooperating relationship for removing the closure from a threaded bottle;

FIG. 6 is an enlarged view of the identified circled area of FIG. 3;

FIG. 7 is a further enlarged view of a portion of the closure illustrated in FIG. 5;

DESCRIPTION OF THE PREFERRED EMBODIMENTS OF THE INVENTION

Figure 1:
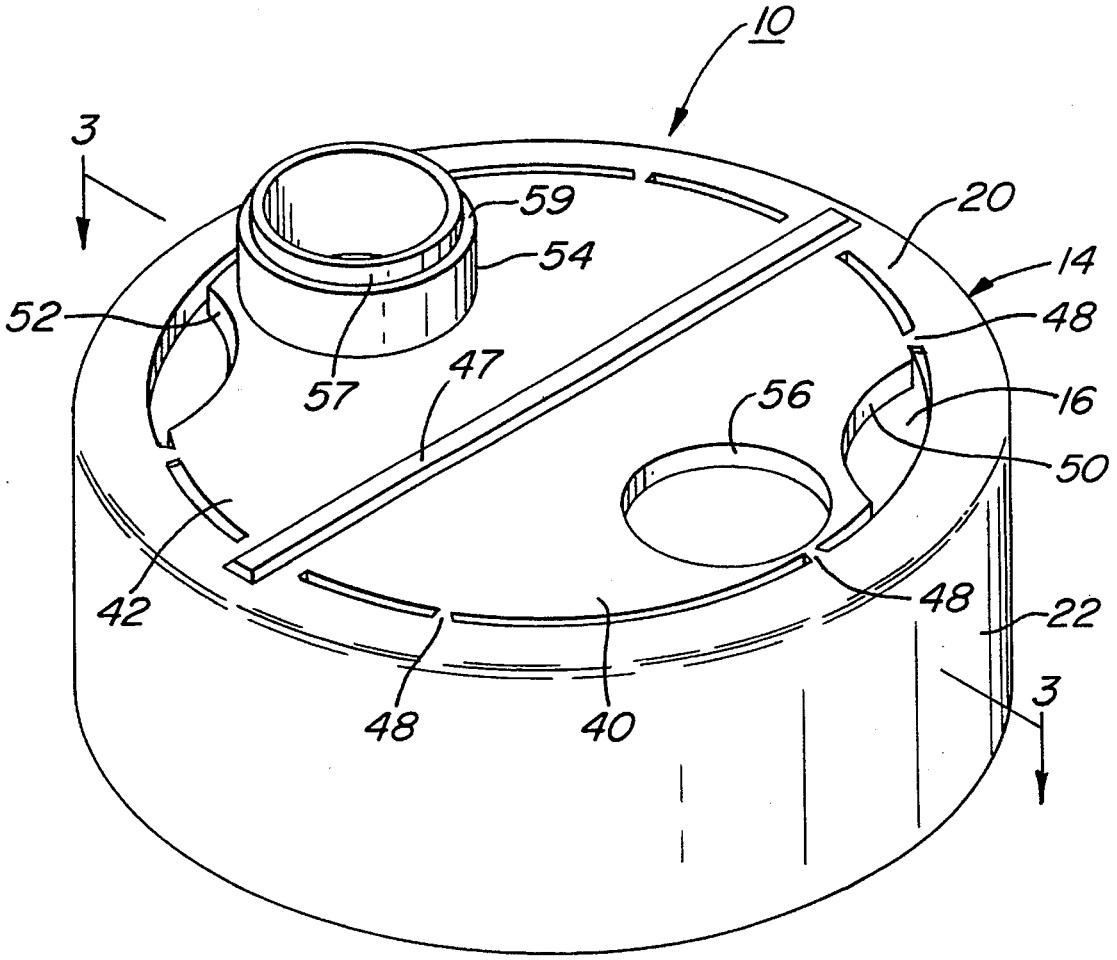
FIG. 1 is an enlarged isometric view of a unique tamper-indicating, child resistant closure of this invention prior to disturbing the tamper-indicating features of the closure.

Referring now in greater detail to the various figures of the drawings wherein like reference characters refer to like parts a tamper-indicating, child resistant closure embodying the present invention is generally shown at 10 at FIG. 1. The closure 10 basically comprises an inner cup shape cap 12 telescoped within an outer cap or driver 14 (FIGS. 1 and 4).

Figure 4:
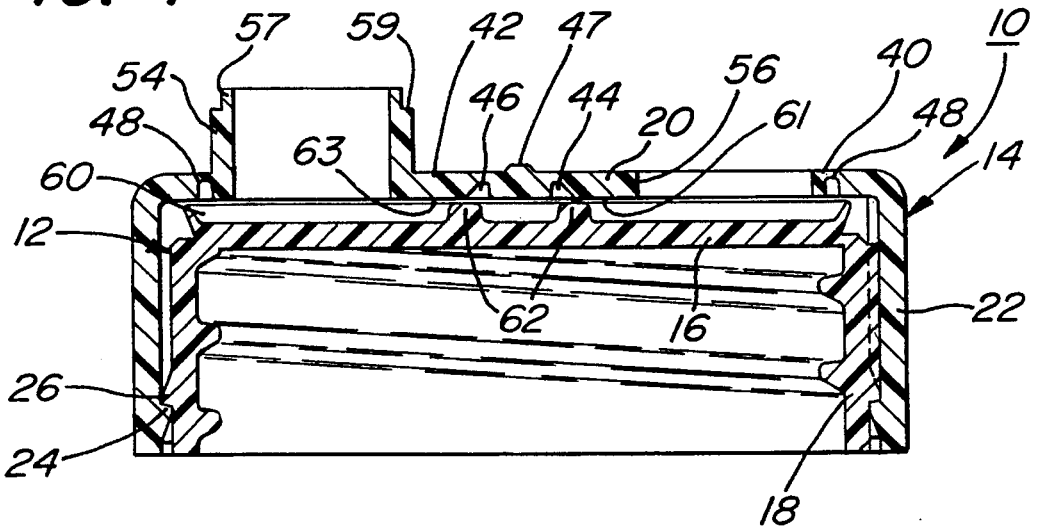
FIG. 4 is an enlarged sectional view taken along line 4—4 of FIG. 3.

Referring specifically to FIG. 4, the inner cap 12 includes a top wall 16 and an internally threaded annular skirt 18. The internally threaded skirt is adapted to cooperate in a conventional manner with external threads provided on the neck of a bottle (not shown). As was set forth earlier herein, all references to "bottle" or "bottles" throughout this application, including the claims, is not intended to be a limitation on the present invention, and is intended to include all kinds of containers, regardless of the shape thereof or the material from which they are made.

Still referring to FIG. 4, the outer driver 14 includes a top wall 20 overlying the top wall 16 of the inner cap 12, and an annular skirt 22 circumscribing the internally threaded skirt 18 of the inner cap. An inwardly directed, continuous circumferential lip 24 provided on the annular outer skirt 22 of the driver 14 overlies an outwardly directed rim or lip 26 provided on the annular skirt 18 of the inner cap 12. The cooperation of the lips 24, 26 retains the inner cap 12 and the outer driver 14 in their telescoping relationship, while at the same time permitting relative axial movement between the inner cap and outer driver to permit proper operation of the closure 10, as will be described in detail hereinafter.

Figure 3:
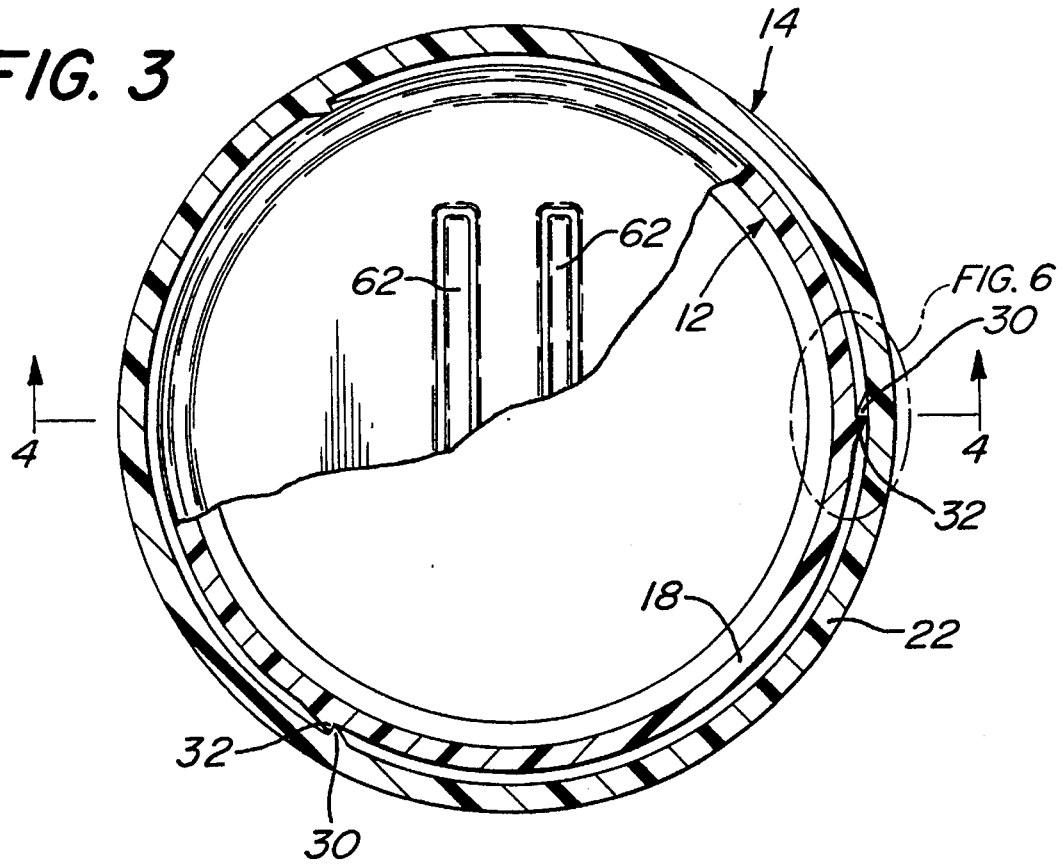
FIG. 3 is an enlarged sectional view taken along stepped line 3—3 of FIG. 1.

Referring specifically to FIG. 3, a first cooperating one-way drive means in the form of oppositely inclined ratchet dogs or teeth 30, 32 are provided on the annular surface of skirt 22 of driver 14 and the outer surface of annular threaded skirt 18 of the inner cap 12, respectively. These cooperating inclined dogs or teeth 30, 32 permit rotational motion imparted to the driver in a clockwise direction, as viewed in FIG. 3, to be transmitted to the inner cap for screwing the inner cap onto the threaded neck of a bottle. However, rotational motion of the driver 14 in the opposite rotational direction (i.e., counter-clockwise as viewed in FIG. 3) will merely cause the inclined ratchet dogs to click past each other without transmitting an opening rotational force or torque to the inner cap 12.

It should be understood that this invention is not limited in any way to the specific one-way drive means discussed above, and that a variety of one-way drive means can be employed in this invention. The only requirement insofar as the present invention is concerned is that the cooperating elements 30, 32, or similar ratchet-like members, be engagable with each other for transmitting torque from the outer driver 14 to the inner cap 12 only when the driver is rotated in a direction to screw the cap onto the threaded neck of a bottle.

The features discussed thus far are generally well known in tamper-indicating, child resistant closures 10, and do not constitute a limitation on the scope of the present invention.

In accordance with this invention, unique cooperating drive means are employed in conjunction with a tamper-indicating structure for permitting rotation of the closure in a closure-opening direction (e.g., counter-clockwise as viewed in FIG. 3), and that rotation can only be achieved by severing or otherwise breaking tamper-indicating features of the closure.

Figure 2:
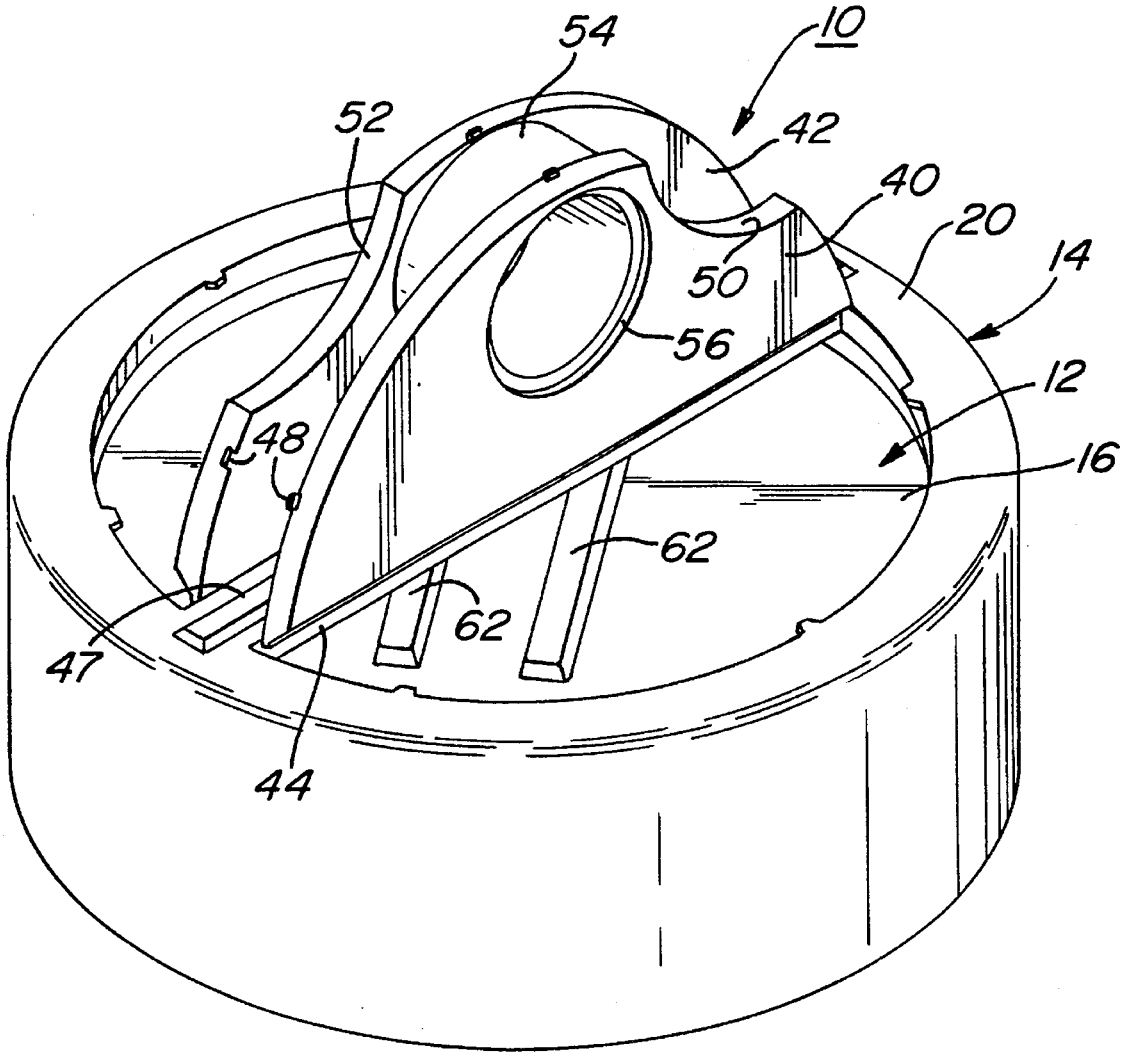
FIG. 2 is an enlarged isometric view similar to FIG. 1, but showing the closure after the tamper-indicating features have been broken, and segments of the top wall of the outer cap or driver have been positioned in a generally vertical orientation to provide a gripping section or handle.

Referring specifically to FIGS. 1, 2 and 4, the top wall 20 of the outer driver 14 includes a pair of top wall segments 40, 42 respectively. These segments preferably are generally arcuate in shape, and, in accordance with one embodiment of the invention, are spaced apart from each other by spaced-apart, thin, recessed hinge regions 44, 46 formed in the lower or inner surface of the top wall 2e. In this embodiment of the invention, the linear segment or spacing rib 47 of the top wall 20 defined between the spaced apart thin recessed regions 44, 46 constitutes the driving section employed to cooperate with the inner cap 12 to unscrew the inner cap from a threaded bottle, in a manner to be described subsequently in this application.

Referring to FIGS. 1 and 4, the top wall segments 40, 42 are connected to contiguous sections of the top wall 20 by frangible, tamper-indicating tabs 48. It should be understood that when the frangible tabs 48 connect the top wall segments 40, 42 to contiguous sections of the top wall, the segments 40, 42 are disposed in a generally horizontal plane, generally perpendicular to the annular skirt 22 of the driver 14.

Referring to FIGS. 1 and 2, an arcuate recess 50 is provided in the top wall segments 40 and arcuate recess 52 is provided in the top wall segment 42 to provide easy access to a user's finger or to some utensil (e.g., a knife, spoon or fork) for use in prying the top wall segments 40, 42 upwardly to break the connections provided by the frangible tabs 48.

Referring to FIGS. 2, 5 and 7, after the tabs 48 are broken the top wall segments 40, 42 can be pivoted about the thin hinge regions 44,46 into a generally vertical orientation to provide a gripping member to enhance leverage in rotating the outer driver 14.

As can be seen best in FIGS. 1, 2, 4, 5 and 7, a raised hub member 54 is provided on the top wall segment 42, and a aperture 56 is provided through top wall segment 40. The annular hub 54 includes a distal end section 57 of a reduced diameter to define a shoulder 59 against which the upper or top surface of top wall segment 40 seats when the distal end section 57 of the hub 54 is frictionally disposed within the aperture 56 of the top wall segment 40. The frictional retention of the distal end section 57 of hub 54 within the aperture 56 retains the top wall segments in a generally vertical orientation and provides a rigidifying connection between such segments to thereby establish a stable gripping member to enhance leverage in rotating the outer driver 14 of the closure 10.

It should be noted that in accordance with this invention a variety of different arrangements can be utilized to interconnect the top wall segments 40, 42 together in their generally vertical orientation, such as interdigitating ribs or projections, integrally molded clip or claw sections, etc. In fact, in accordance with the broadest aspects of this invention the top wall segments are not required to be provided with any rigidifying interconnection.

As noted earlier, in this embodiment of the invention the spacing rib 47 of the top wall 20 located between the thin hinge regions 44, 46 constitutes a driving section that is designed to cooperate with complimentary drive means provided on the top wall 16 of the inner cap 12 only after the frangible tabs 48 on the top wall 20 of the outer cap 14 have been broken and the top wall segments 40, 42 have been moved from their generally horizontal position as shown in FIG. 1, to their generally vertical position as shown in FIGS. 2, 5 and 7. It is only when the top wall segments 40, 42 are in their general vertical orientation that the outer driver 14 and inner cap 12 can be moved axially toward each other a sufficient distance to bring the driving section 47 into cooperating driving engagement with drive means formed on the top wall 16 of the inner cap 12.

Referring specifically to FIGS. 2, 4, 5 and 7, the drive means formed on the top wall 16 of the inner cap 12 includes spaced apart, upstanding ribs 62. These ribs 62 are spaced apart a distance for closely receiving the driving section 47 between them, after the pair of top wall segments 40, 42 have been moved out of their generally horizontal position (See FIGS. 5 and 7). It should be noted that the driving section 47 is pressed into the space between the upstanding ribs 62 on the top wall 16 of the inner cap 12 by applying a downward force to the driver 14, as viewed in FIGS. 5 and 7, against the biasing force imposed by an annular rib 60 formed integrally with the inner cap 12. In this position, spaced-apart, elongate side walls 47' of the driving section 47, which are created by the formation of the weakened hinge regions 44, 46, can engage contiguous inner surfaces 62' of the upstanding ribs 62 to transmit a rotational driving force from the driver 14 to the inner cap 12. (See FIG. 7)

The annular rib 60 engages the outer driver 14 to normally bias the outer driver 14 and inner cap 12 a sufficient distance apart to maintain the driving section 47 out of engagement with the spaced apart upstanding ribs 62 on the top wall 16 of the inner cap 12 to thereby normally prevent a driving force from being transmitted from the outer cap to the inner cap. This annular rib 60 desirably also biases the outer driver 14 and the inner cap 12 apart after the downward force on the driver is released.

Moreover, as can be seen best in FIG. 4, when the top wall segments 40, 42 are in a generally horizontal plane, such as when they are connected to contiguous top wall sections by the frangible tabs 48, portions of the upstanding ribs 62 of the top wall 16 of the inner cap 12 engage lower surfaces 61, 63 of the segments 40, 42, respectively, even when the linear driving section 47 is aligned (i.e., parallel) with the space between the ribs 62. This prevents the driver 14 from being moved axially downwardly relative to the inner cap 12 to a position in which the driving section 47 is between the ribs 62. Thus, with the frangible tabs 48 unbroken, a driving connection cannot be established between the driving section 47 and the ribs 62 to remove the closure 10 from a threaded bottle.

However, once the top wall segments 40, 42 are moved into a generally vertical position (which requires breaking the frangible tabs 48), as is illustrated in FIGS. 2, 5, and 7, and a downward force is applied to the driver 14, the driving section 47 is seated within the space provided between the upstanding ribs 62 on the top wall 16 of the inner cap 12, to thereby impart a driving force from the driver to the inner cap.

It should be understood that prior to being able to provide an axial force on the driver 14 to move the driving section 47 into the space between the upstanding ribs 62, it is necessary to first rotate the driver 14 in a counter-clockwise direction relative to the inner cap 12 to thereby align the elongate linear driving section 47 with the linear space between the upstanding ribs 62. This orientation is easily observable by a user of the device after the top wall segments 40, 42 have been moved to the generally vertical orientation, as is illustrated in FIGS. 2, 5 and 7.

It should be understood that once the driving section 47 forming part of the top wall 20 of the driver 14 seats between the upstanding ribs 62 associated with the top wall 16 of the inner cap 12, counter-clockwise rotation of the driving section 47 by a user engaging the upstanding top wall segments 40, 42 causes the inner cap to be rotated in a counter-clockwise direction, as viewed in FIGS. 2 and 3, to thereby remove the cap from the threaded neck of a bottle.

Figure 8:
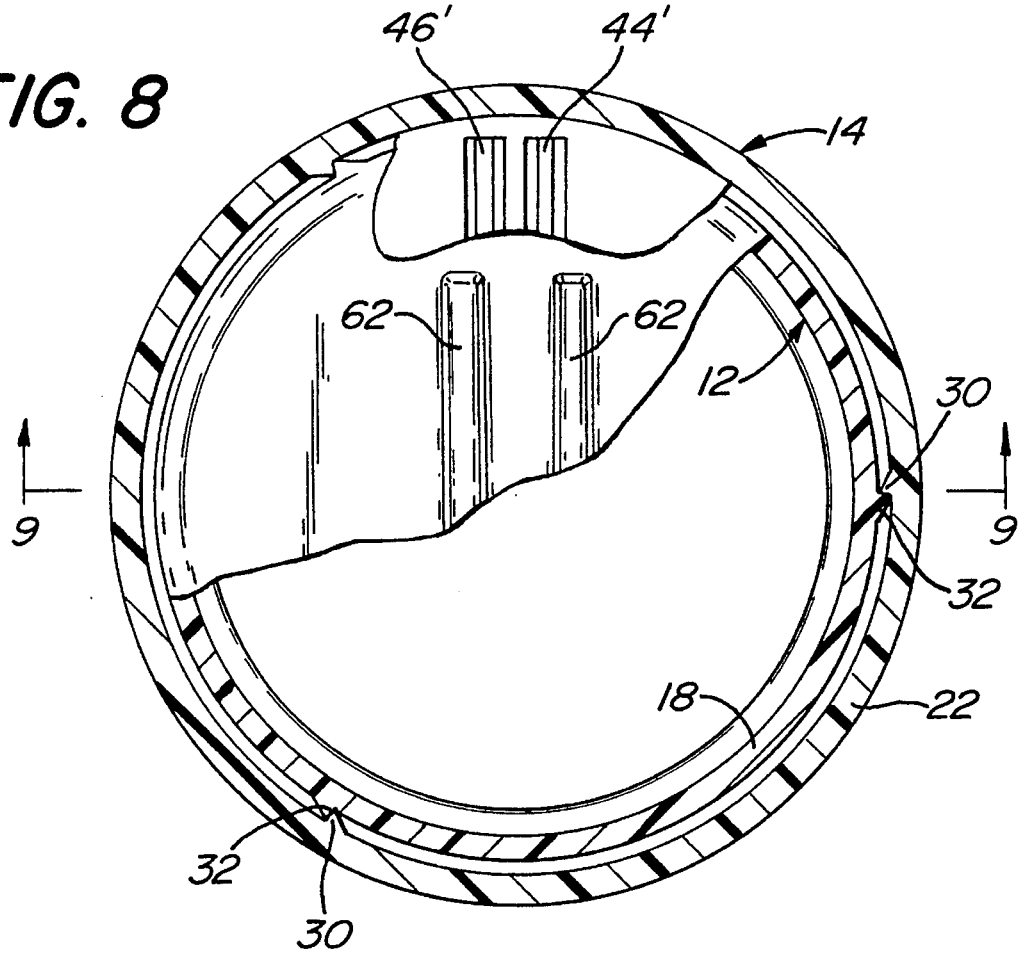
FIG. 8 is an enlarged sectional view identical to FIG. 3, but showing an alternative embodiment of this invention.
Figure 9:
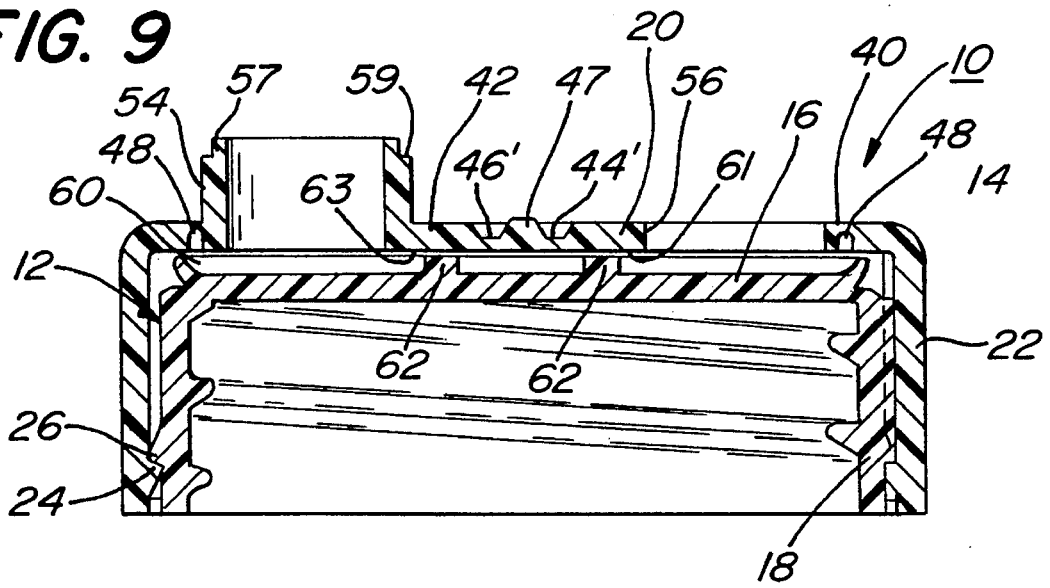
FIG. 9 is an enlarged sectional view identical to FIG. 4, but showing the alternative embodiment of FIG. 8.
Figure 10:
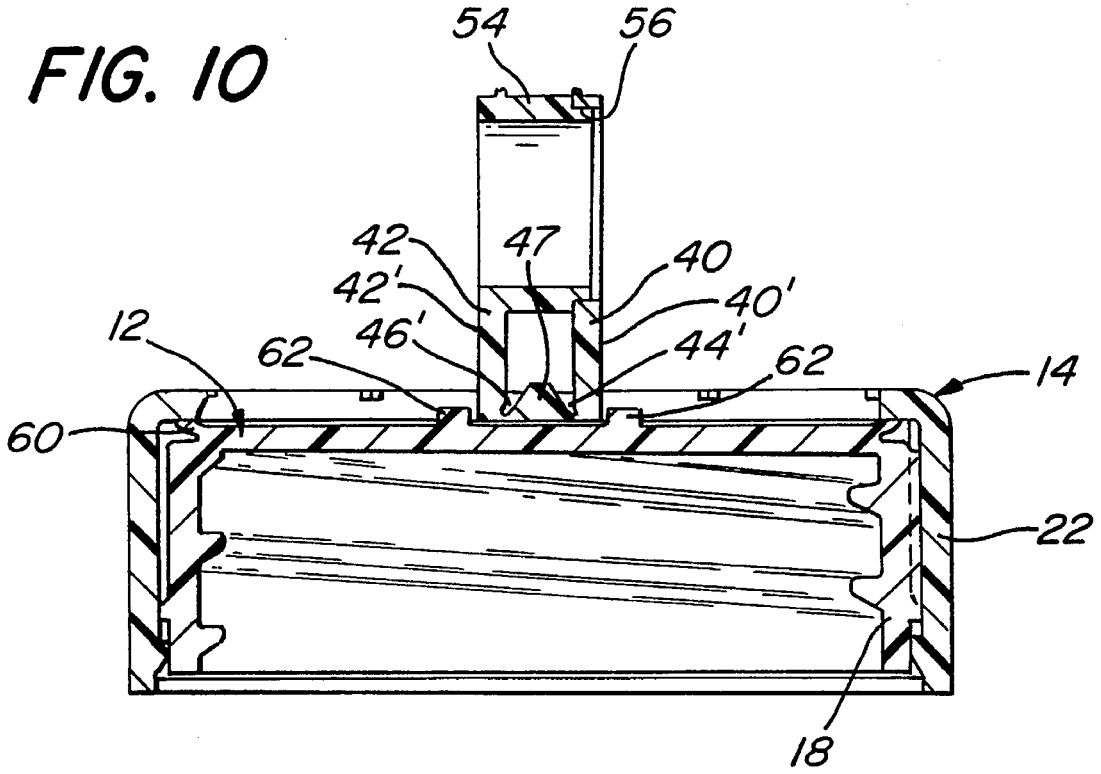
FIG. 10 is an enlarged sectional view identical to FIG. 5, but showing the alternative embodiment of FIG. 8.

Referring to FIGS. 8–10, an alternative embodiment of this invention is illustrated, wherein parts that are identical to corresponding parts of the above-described embodiment of this invention are identified with the same numerals.

The embodiment illustrated in FIGS. 8–11, is identical to the embodiment illustrated in FIGS. 1–7, except for the location of the thin hinge areas separating the top wall segments 40, 42 from each other. Thus, the discussion which follows is directed solely to this difference.

Still referring to FIGS. 8–11, thin hinge areas 44', 46', unlike the thin hinge areas 44, 46 in the first embodiment of the invention, are formed by providing recesses in the upper surface of the top wall, as opposed to the lower surface of the top wall. As a result of this arrangement the driving section created by pivoting the top wall segments 40, 42 into a substantially vertical orientation includes the spacing rib 47 and regions of the top wall segments adjacent to the spacing rib. This arrangement of the driving section can be seen best in FIGS. 10 and 11.

Figure 11:
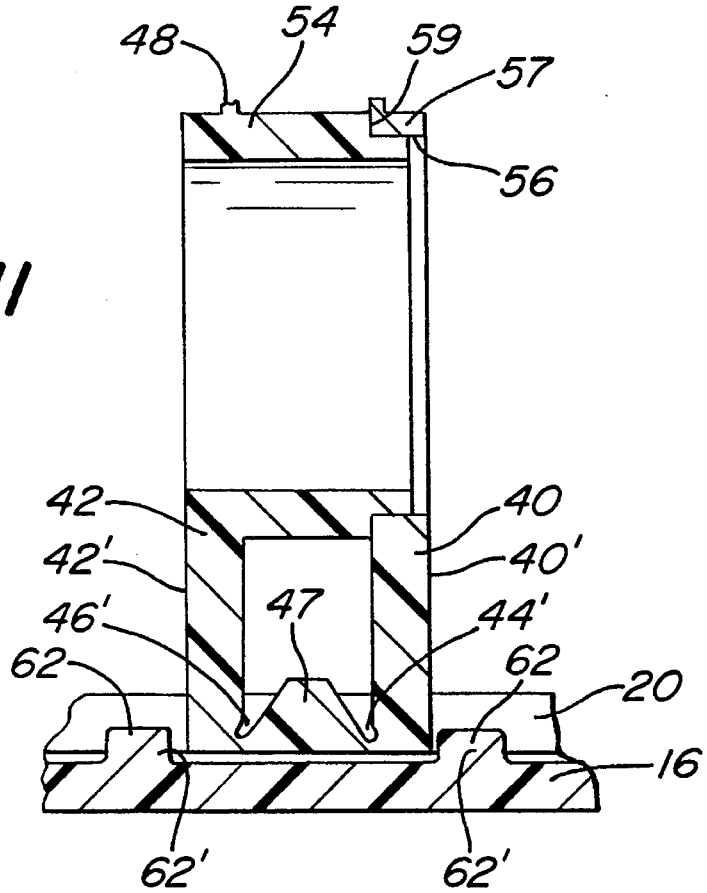
FIG. 11 is an enlarged view of a portion of the closure illustrated in FIG. 10.

Referring specifically to FIGS. 10 and 11, in this embodiment of the invention outwardly facing surfaces 40', 42' of the top wall segments 40, 42, respectively, constitute sidewalls of the driving section that are contiguous to the inwardly facing surfaces 62' of the ribs 62 to transmit rotational motion imparted to the driver b4 to the inner cap 12.

Referring specifically to FIG. 9, it should be noted that providing recesses in the upper surface of the top wall of the driver 14 to form the thin hinge regions, the lower or inner surface of the top wall is uninterrupted by the recesses in the thin hinge regions. Thus, in the design of the embodiment illustrated in FIGS. 8–11, one does not need to be concerned about locating the upstanding ribs 62 on the top wall of the inner cap 12 and/or adjusting their thickness to prevent the ribs from entering the recesses providing the thin hinge areas in the top wall of the driver 14, as in the embodiment of the invention illustrated in FIGS. 1–7.

In all respects other than as discussed above, the embodiment of the invention illustrated in FIGS. 8–11 is identical to the embodiment of the invention illustrated in FIGS. 1–7, and can include the same modifications as in the embodiment of the invention illustrated in FIGS. 1–7. Thus, no additional discussion or explanation of the embodiment of the invention illustrated in FIGS. 8–11, is considered to be necessary herein.

It should be understood that reference throughout this application to the top wall segments being either in a horizontal position or a vertical position is intended to describe the positions that the top wall segments occupy when the driver 14 is telescoped over the inner cap 12 and the inner cap 12 is threaded onto a bottle maintained in a generally upright position. Thus, the references to horizontal and vertical positions of the top wall segments are intended to describe relative positions of those segments to each other, as opposed to positions relative to a fixed point in space.

From the above description it should be noted that the present invention provides a tamper-indicating, child resistant closure 10 wherein an outer driver 14 includes an upstanding gripping section in the form of two top wall segments 40, 42 to thereby provide or enhance leverage in removing the closure 10 from a threaded bottle. Moreover, this leverage is achieved only after frangible tabs 48 are broken to permit vertical movement of the top wall segments 40, 42 from a generally horizontal position to a general vertical position. Furthermore, the cooperation between the driving section 47 forming part of the top wall 20 of the driver 14 with the upstanding ribs 62 forming part of the top wall 16 of the inner cap 12 can only be achieved after the tamper-indicating tabs 48 have been broken, the top wall segments 40, 42 moved out of their generally horizontal position, and the driver 14 and cap 12 moved axially toward each other to thereby bring the driving section 47 into the space provided between the upstanding ribs 62.

Without further elaboration, the foregoing will also fully illustrate my invention that others may, by applying current or future knowledge, adopt the same for use under various conditions of service.

What we claim as the invention is:

1. A tamper-indicating, child resistant closure for a threaded bottle, said closure including:

an inner cap including a top wall and an internally threaded peripheral skirt;

an outer driver including a top wall and a peripheral skirt, said outer driver being telescoped over the inner cap with the top wall of the outer driver being spaced axially outward of the top wall of the inner cap, said top walls of the outer driver and the inner cap being axially movable relative to each other;

biasing means for normally biasing the top walls of the outer driver and inner cap axially away from each other;

cooperating one-way drive means on adjacent parts of the cap and driver engagable for permitting rotational motion imparted to the driver to be transmitted to the inner cap for screwing the inner cap onto the bottle; and second drive means for permitting rotational motion imparted to the driver to be transmitted to the inner cap for unscrewing the inner cap from the bottle, the improvement wherein said second drive means includes;

(1) a pair of top wall segments forming part of the top wall of the outer driver, said pair of top wall segments being hinged for pivotal movement to, and being spaced apart from each other by a spacing rib forming part of the top wall of the outer driver, each of said top wall segments also being secured to contiguous sections of said outer driver by frangible, tamper-indicating tabs, said top wall segments being prevented from pivotal movement until said frangible tabs are broken, and, after said frangible tabs are broken, being permitted to pivotally move from a generally horizontal position to a generally vertical position for forming a driving section in the top wall, said top wall segments when in the generally vertical position constituting a manually engagable gripping means for rotating the outer driver; and (2) drive means on the top wall of the inner cap for engaging with and being driven by the driving section in the top wall of the outer driver after the frangible tabs are broken, the top wall segments of the outer driver are pivotally moved out of their generally horizontal position, and the top walls of the outer driver and inner cap are moved axially toward each other against the force of the biasing means.

2. The closure of claim 1, wherein the driving section in the top wall of the outer driver is the spacing rib.

3. The closure of claim 1, wherein the driving section in the top wall of the outer driver includes the spacing rib and a part of the top wall segments contiguous to said spacing rib.

4. The closure of claim 1, wherein said drive means on the top wall of the inner cap includes raised projection means for engaging at least a portion of a top wall segment of the top wall of the outer driver when said top wall segment is in a generally horizontal plane for maintaining the top walls of the outer driver and inner cap axially spaced-apart a sufficient distance for preventing the drive means on the top wall of the inner cap from engaging with and being driven by the driving section of the outer driver.

5. The closure of claim 4, wherein said raised projection means includes a pair of spaced-apart projections that are spaced-apart a sufficient distance for receiving the driving section of the outer driver therebetween when the top wall segments adjacent the driving section are disposed in the generally vertical position.

6. The closure of claim 5, wherein one of said pair of spaced-apart projections underlies at least a portion of one of said pair of top wall segments of the top wall of the outer driver when said one of said pair of top wall segments is in a generally horizontal plane and a second of said pair of spaced-apart projections underlies at least a portion of a second of said pair of top wall segments of the top wall of the outer driver when said other of said pair of top wall segments is in a generally horizontal plane, said pair of spaced-apart projections and said pair of top wall segments cooperating for maintaining the top walls of the outer driver and inner cap axially spaced-apart a sufficient distance for preventing the driving section of the top wall of the outer driver from being disposed within the space between the spaced-apart projections on the top wall of the inner cap.

7. The closure of claim 1, further including securing means for interconnecting the pair of top wall segments together when said top wall segments are disposed in the substantially vertical position.

8. The closure of claim 7, wherein said securing means includes surfaces on the pair of top wall sections that frictionally engage each other when said pair of top wall sections are disposed in said substantially vertical position to thereby secure the top wall sections together in said substantially vertical position.

9. The closure of claim 7, wherein said securing means includes a hub section extending outwardly from one of said pair of top wall sections and an aperture extending through the other of said pair of top wall sections, said hub section being frictionally received with the aperture when said pair of top wall sections are disposed in said substantially vertical position to thereby secure the top wall sections together in said substantially vertical position.

* * * * *